US010930427B2

(12) United States Patent
Yoon et al.

(10) Patent No.: US 10,930,427 B2
(45) Date of Patent: Feb. 23, 2021

(54) COIL COMPONENT

(71) Applicant: SAMSUNG ELECTRO-MECHANICS CO., LTD., Suwon-si (KR)

(72) Inventors: Hee Soo Yoon, Suwon-Si (KR); Jae Woon Park, Suwon-Si (KR); Seung Jae Song, Suwon-Si (KR); Sang Jong Lee, Suwon-Si (KR); Min Ki Jung, Suwon-si (KR); Seung Hee Hong, Suwon-Si (KR); Su Bong Jang, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 288 days.

(21) Appl. No.: 16/169,616

(22) Filed: Oct. 24, 2018

(65) Prior Publication Data

US 2019/0279811 A1 Sep. 12, 2019

(30) Foreign Application Priority Data

Mar. 9, 2018 (KR) ..... 10-2018-0028216
May 15, 2018 (KR) ..... 10-2018-0055341

(51) Int. Cl.

| | |
|---|---|
| ***H01F 27/29*** | (2006.01) |
| ***H01F 27/28*** | (2006.01) |
| ***H01F 17/04*** | (2006.01) |
| ***H01F 17/00*** | (2006.01) |

(52) U.S. Cl.

CPC ..... *H01F 27/2885* (2013.01); *H01F 17/0013* (2013.01); *H01F 17/04* (2013.01); *H01F 27/2804* (2013.01); *H01F 27/29* (2013.01); *H01F 27/292* (2013.01); *H01F 2017/008* (2013.01); *H01F 2017/048* (2013.01)

(58) Field of Classification Search

CPC .... H01F 27/2885; H01F 17/04; H01F 27/292; H01F 17/0013; H01F 27/2804; H01F 27/29; H01F 2017/008; H01F 2017/048; H01F 27/346

See application file for complete search history.

(56) References Cited

U.S. PATENT DOCUMENTS

| | | | | |
|---|---|---|---|---|
| 8,395,472 | B2 * | 3/2013 | Roozeboom | H01F 17/0006 336/200 |
| 9,905,349 | B2 * | 2/2018 | Park | H01F 17/04 |
| 2012/0013429 | A1 | 1/2012 | Kim et al. | |
| 2016/0293316 | A1 | 10/2016 | Park et al. | |

FOREIGN PATENT DOCUMENTS

| | | | |
|---|---|---|---|
| JP | 2005-310863 | A | 11/2005 |
| KR | 10-2012-0007831 | A | 1/2012 |
| KR | 10-2016-0118052 | A | 10/2016 |

* cited by examiner

*Primary Examiner* — Tuyen T Nguyen
(74) *Attorney, Agent, or Firm* — Morgan, Lewis & Bockius LLP

(57) ABSTRACT

A coil component includes: a body; a coil part including a coil pattern embedded in the body and having at least one turn winding around on one direction; first and second external electrodes disposed on a surface of the body and connected to the coil part; and a shielding via having a permeability higher than that of the body and extending along the one direction in the body.

8 Claims, 5 Drawing Sheets

COIL COMPONENT

CROSS-REFERENCE TO RELATED APPLICATION(S)

This application claims benefit of priority to Korean Patent Application Nos. 10-2018-0028216 filed on Mar. 9, 2018 and 10-2018-0055341 filed on May 15, 2018 in the Korean Intellectual Property Office, the disclosure of which is incorporated herein by reference in its entirety.

TECHNICAL FIELD

The present disclosure relates to a coil component.

BACKGROUND

An inductor, a coil component, is a representative passive electronic component used in an electronic device together with a resistor and a capacitor.

In accordance with high performance and miniaturization of the electronic device, the electronic component used in the electronic device has increased in number and decreased in size.

Due to the above-mentioned reason, requirements for removing a noise generation source such as electromagnetic interference (EMI) of the electronic component has gradually increased.

Currently, in a general EMI shielding technology, after mounting an electronic component on a board, the electronic component and the board are simultaneously enclosed by a shield can.

SUMMARY

An aspect of the present disclosure may provide a coil component capable of decreasing a leakage magnetic flux.

An aspect of the present disclosure may also provide a coil component capable of improving characteristics of the component such as inductance L, a quality (Q) factor, and the like, while decreasing a leakage magnetic flux.

According to an aspect of the present disclosure, a coil component may include a shielding via having a permeability higher than that of a body and extending in the body in the same direction as a turn direction of a coil part.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
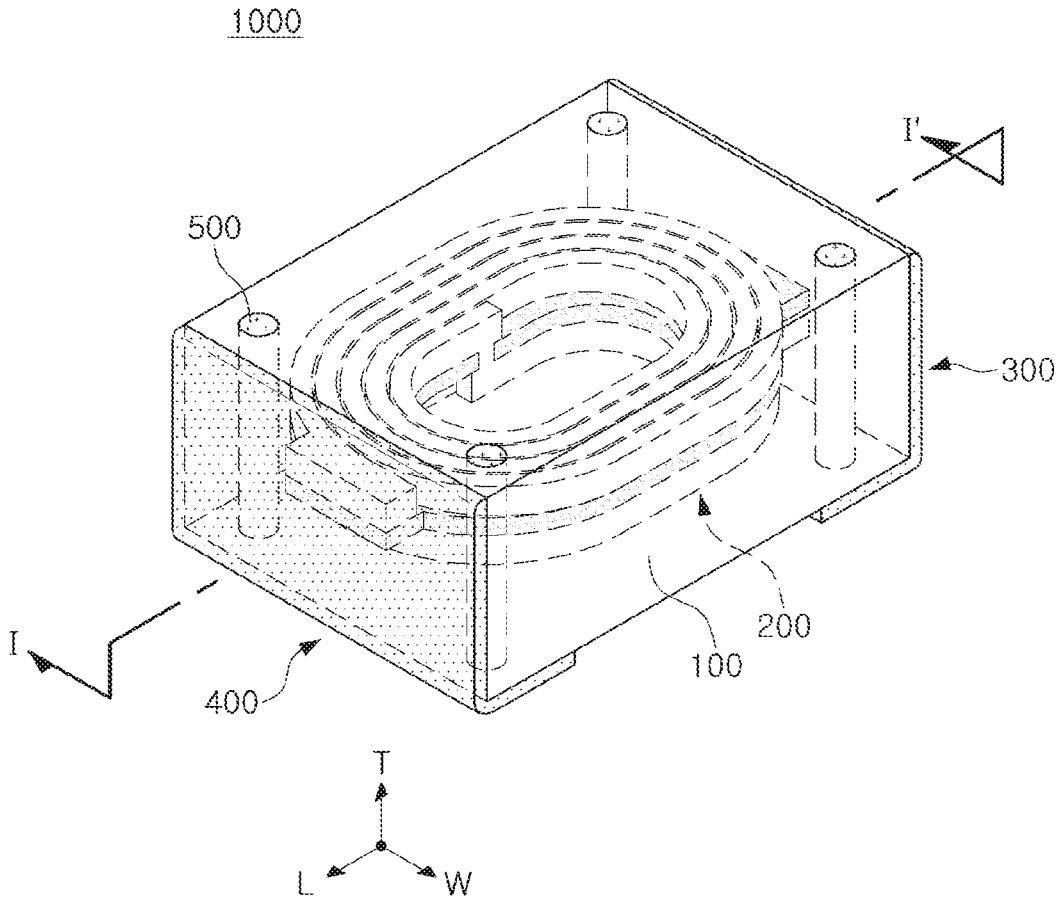
FIG. 1 is a perspective view schematically showing a coil component according to a first exemplary embodiment in the present disclosure.

Hereinafter, exemplary embodiments of the present disclosure will now be described in detail with reference to the accompanying drawings.

In the accompanying drawings, an L direction refers to a first direction or a length direction, a W direction refers to a second direction or a width direction, and a T direction refers to a third direction or a thickness direction.

Hereinafter, a coil component according to an exemplary embodiment in the present disclosure will be described in detail with reference to the accompanying drawings. In describing an exemplary embodiment in the present disclosure with reference to the accompanying drawings, components that are the same as or correspond to each other will be denoted by the same reference numerals, and an overlapped description thereof will be omitted.

Various kinds of electronic components are used in an electronic device, and various kinds of coil components may be appropriately used for the purpose of removing noise, or the like, between the electronic components.

That is, the coil component may be used as a power inductor, a high-frequency (HF) inductor, a general bead, a GHz bead, a common mode filter, and the like, in the electronic device.

First Exemplary Embodiment

Figure 2:
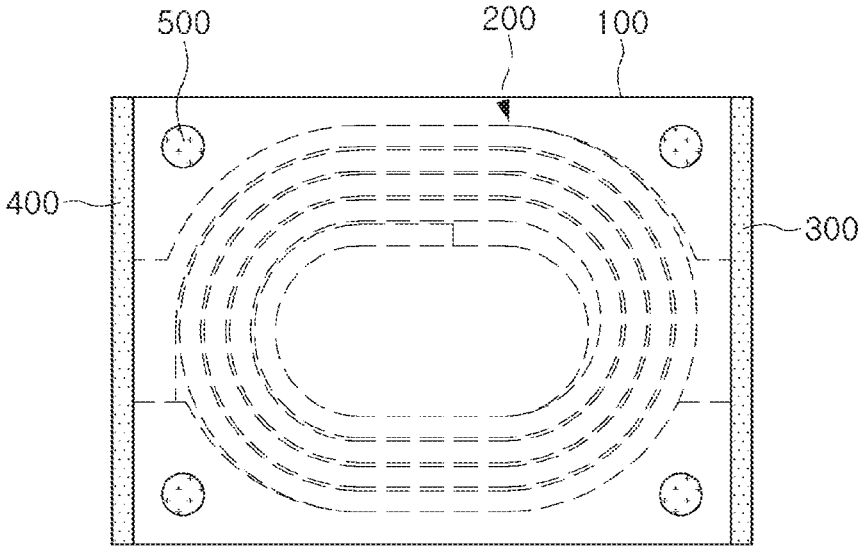
FIG. 2 is a plan view schematically illustrating the coil component according to the first exemplary embodiment in the present disclosure.
Figure 3:
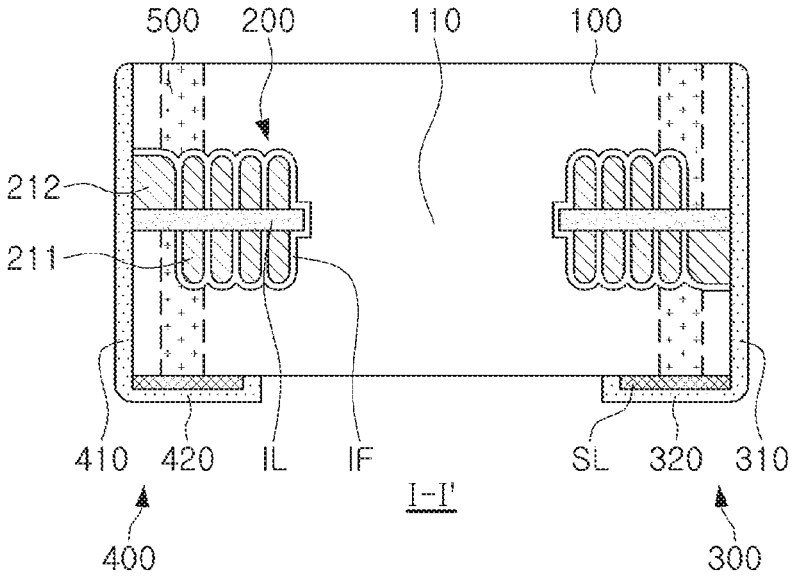
FIG. 3 is a cross-sectional view taken along line I-I' of FIG. 1.

FIG. 1 is a perspective view schematically showing a coil component according to a first exemplary embodiment in the present disclosure. FIG. 2 is a plan view schematically illustrating the coil component according to the first exemplary embodiment in the present disclosure. FIG. 3 is a cross-sectional view taken along line I-I' of FIG. 1.

Referring to FIGS. 1 through 3, a coil component 1000 according to the first exemplary embodiment in the present disclosure may include a body 100, a coil part 200, external electrodes 300 and 400, and a shielding via 500, and further include an internal insulating layer IL and an insulating film IF.

The body 100 may form an exterior of the coil component 1000 according to the present exemplary embodiment, and the coil part 200 may be embedded therein.

The body 100 may be formed in an entirely hexahedral shape.

Hereinafter, as an example, the first exemplary embodiment in the present disclosure will be described on the assumption that the body 100 has a hexahedral shape. However, a coil component including a body formed in a shape other than the hexahedral shape is not excluded in the scope of the present exemplary embodiment by the description.

The body 100 may have first and second surfaces opposing each other in the length (L) direction, third and fourth surfaces opposing each other in the width (W) direction, and fifth and sixth surfaces opposing each other in the thickness (T) direction in FIG. 1. The first to fourth surfaces of the body 100 may correspond to wall surfaces of the body 100 connecting the fifth and sixth surfaces of the body 100 to each other, respectively. The wall surfaces of the body 100 may include the first and second surfaces corresponding to both end surfaces opposing each other and the third and fourth surfaces corresponding to both side surfaces opposing each other.

For example, the body 100 may be formed so that the coil component 1000 in which the external electrodes 300 and 400 to be described below are formed has a length of 2.0 mm, a width of 1.2 mm, and a thickness of 0.65 mm, but the body 100 is not limited thereto.

The body 100 may contain a magnetic material and a resin. More specifically, the body 100 may be formed by stacking one or more magnetic composite sheets in which the magnetic material is dispersed in the resin. However, the body 100 may also have a different structure other than a structure in which the magnetic material is dispersed in the resin. For example, the body 100 may also be formed of a magnetic material such as ferrite.

The magnetic material may be ferrite or a metal magnetic powder.

As an example, the ferrite powder may be formed of at least one selected from spinel type ferrite such as Mg—Zn based ferrite, Mn—Zn based ferrite, Mn—Mg based ferrite, Cu—Zn based ferrite, Mg—Mn—Sr based ferrite, and Ni—Zn based ferrite; hexagonal ferrite such as Ba—Zn based ferrite, Ba—Mg based ferrite, Ba—Ni based ferrite, Ba—Co based ferrite, and Ba—Ni—Co based ferrite; garnet type ferrite such as Y based ferrite; and Li based ferrite.

The metal magnetic powder may contain one or more selected from the group consisting of iron (Fe), silicon (Si), chromium (Cr), cobalt (Co), molybdenum (Mo), aluminum (Al), niobium (Nb), copper (Cu), and nickel (Ni). For example, the metal magnetic powder may be at least one of pure iron powder, Fe—Si based alloy powder, Fe—Si—Al based alloy powder, Fe—Ni based alloy powder, Fe—Ni—Mo based alloy powder, Fe—Ni—Mo—Cu based alloy powder, Fe—Co based alloy powder, Fe—Ni—Co based alloy powder, Fe—Cr based alloy powder, Fe—Cr—Si based alloy powder, Fe—Si—Cu—Nb based alloy powder, Fe—Ni—Cr based alloy powder, and Fe—Cr—Al based alloy powder.

The metal magnetic powder may be amorphous or crystalline. For example, the metal magnetic powder may be Fe—Si—B—Cr based amorphous metal powder, but is not necessarily limited thereto.

The ferrite and the metal magnetic powder may each have an average diameter of about 0.1 μm to 30 μm, but are not limited thereto.

The body 100 may contain two or more kinds of magnetic materials dispersed in the resin. Here, the phrase "different kinds of magnetic materials" means that the magnetic materials dispersed in the resin are distinguished from each other in any one of an average diameter, a composition, crystallinity, and a shape thereof.

The resin may include one or a mixture of epoxy, polyimide, a liquid crystal polymer (LCP), and the like, but is not limited thereto.

The body 100 may include a core 110 penetrating through a coil part 200 to be described below. The core 110 may be formed by filling the magnetic composite sheet in a through hole of the coil part 200, but is not limited thereto.

The coil part 200 may be embedded in the body 100 and exhibit characteristics of the coil component. For example, when the coil component 1000 according to the present exemplary embodiment is used as a power inductor, the coil part 200 may serve to stabilize a power source of an electronic device by storing an electric field as a magnetic field to maintain an output voltage.

The coil part 200 may form at least one turn winding around one direction. As an example, the coil part 200 may form at least one turn winding around the thickness (T) direction of the body 100.

The coil part 200 may include a first coil pattern 211, a second coil pattern 212, and a connection via (not illustrated).

The first and second coil patterns 211 and 212 and an internal insulating layer IL to be described below may be formed to be stacked in the thickness (T) direction of the body 100. That is, the internal insulating layer IL may have one surface and the other surface opposing each other in the thickness (T) direction, and the first and second coil patterns 211 and 212 may be formed on one surface and the other surface of the internal insulating layer IL, respectively.

Each of the first and second coil patterns 211 and 212 may be formed in a flat spiral shape. As an example, the first coil pattern 211 may form at least one turn on one surface of the internal insulating layer IL winding around the thickness (T) direction of the body 100.

The connection via may penetrate through the internal insulating layer IL so as to electrically connect the first and second coil patterns 211 and 212 to each other, thereby coming in contact with each of the first and second coil patterns 211 and 212. As a result, the coil part 200 applied to the present exemplary embodiment may be formed as a single coil generating a magnetic field in the thickness (T) direction of the body 100.

At least one of the first and second coil patterns 211 and 212 and the connection via may include at least one conductive layer.

As an example, when the second coil pattern 212 and the connection via are formed by plating, each of the second coil pattern 212 and the connection via may include an internal seed layer of an electroless plating layer and an electroplating layer. Here, the electroplating layer may have a monolayer structure or a multilayer structure. The electroplating layer having the multilayer structure may also be formed in a conformal film structure in which one electroplating layer is covered with another electroplating layer. Alternatively, the electroplating layer having the multilayer structure may also be formed so that only on one surface of one electroplating layer, another electroplating layer is stacked. The internal seed layer of the second coil pattern 212 and the internal seed layer of the connection via may be formed integrally with each other so that a boundary therebetween is not formed, but the internal seed layer of the second coil pattern 212 and the internal seed layer of the connection via are not limited thereto. The electroplating layer of the second coil pattern 212 and the electroplating of the connection via may be formed integrally with each other so that a boundary therebetween is not formed, but the electroplating layer of the second coil pattern 212 and the electroplating of the connection via are not limited thereto.

As another example, when the coil part 200 is formed by separately forming the first and second coil patterns 211 and 212 and then collectively stacking the first and second coil patterns 211 and 212 on the internal insulating layer IL, the connection via may include a high-melting point metal layer and a low-melting point metal layer having a melting point lower than that of the high-melting point metal layer. Here, the low-melting point metal layer may be formed of solder containing lead (Pb) and/or tin (Sn). The low-melting point metal layer may be at least partially melted by a pressure and a temperature at the time of collective stacking, such that an inter-metallic compound (IMC) layer may be formed in a boundary between the low-melting point metal layer and the second coil pattern 212.

As an example, the first and second coil patterns 211 and 212 may be formed to protrude on lower and upper surfaces of the internal insulating layer (IL), respectively. As another example, the first coil pattern 211 may be embedded in the lower surface of the internal insulating layer IL so that a lower surface thereof is exposed to the lower surface of the internal insulating layer IL, and the second coil pattern 212 may be formed to protrude on the upper surface of the internal insulating layer IL. In this case, a concave portion may be formed in the lower surface of the first coil pattern 211, such that the lower surface of the internal insulating layer IL and the lower surface of the first coil pattern 211 may not be positioned on the same plane. As another example, the first coil pattern 211 may be embedded in the lower surface of the internal insulating layer IL so that the lower surface thereof is exposed to the lower surface of the internal insulating layer IL, and the second coil pattern 212 may be embedded in the upper surface of the internal insulating layer IL so that an upper surface thereof is exposed to the upper surface of the internal insulating layer IL.

End portions of the first and second coil patterns 211 and 212 may be exposed to the first and second surfaces, both ends surface of the body 100, respectively. The end portion of the first coil pattern 211 exposed to the first surface of the body 100 may come in contact with a first external electrode 300 to be described below, such that the first coil pattern 211 may be electrically connected to the first external electrode 300. The end portion of the second coil pattern 212 exposed to the second surface of the body 100 may come in contact with a second external electrode 400 to be described below, such that the second coil pattern 212 may be electrically connected to the second external electrode 400.

The first and second coil patterns 211 and 212 and the connection via may each be formed of a conductive material such as copper (Cu), aluminum (Al), silver (Ag), tin (Sn), gold (Au), nickel (Ni), lead (Pb), titanium (Ti), or alloys thereof, but are not limited thereto.

The internal insulating layer IL may be formed of an insulating material including at least one of thermosetting insulating resins such as an epoxy resin, thermoplastic insulating resins such as polyimide, and photosensitive insulating resins, or an insulating material in which a reinforcing material such as glass fiber or an inorganic filler is impregnated in this insulating resin. As an example, the internal insulating layer IL may be formed of an insulating material such as prepreg, an Ajinomoto build-up film (ABF), FR-4, a bismaleimide triazine resin, a photoimageable dielectric (PID), or the like, but is not limited thereto.

As the inorganic filler, at least one selected from the group consisting of silica ($SiO_2$), alumina ($Al_2O_3$), silicon carbide (SiC), barium sulfate ($BaSO_4$), talc, mud, mica powder, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the internal insulating layer IL is formed of an insulating material containing a reinforcing material, the internal insulating layer IL may provide more excellent rigidity. When the internal insulating layer IL is formed of an insulating material that does not contain glass fiber, the internal insulating layer IL is advantageous for thinning a thickness of the entire coil part 200. When the internal insulating layer IL is formed of an insulating material containing a photosensitive insulating resin, the number of processes may be decreased, which is advantageous for decreasing a manufacturing cost, and the connection via may be more finely formed.

The insulating film IF may be formed along surfaces of the first coil pattern 211, the internal insulating layer IL, and the second coil pattern 212. The insulating film IF may protect and insulate the respective coil patterns 211 and 212 and contain an insulating material known in the art such as parylene, or the like. Any insulating material may be contained in the insulating film IF without particular limitation. The insulating film IF may be formed by a method such as a vapor deposition method, but is not limited thereto. The insulating film IF may be formed by stacking an insulation film on both surfaces of the internal insulating layer IL on which the first and second coil patterns 211 and 212 are formed.

Meanwhile, although not illustrated, at least one of the first and second coil patterns 211 and 212 may be formed in plural. As an example, the coil part 200 may have a structure in which a plurality of first coil patterns 211 are formed, and another first coil pattern is stacked on a lower surface of one first coil pattern. In this case, another internal insulating layer may be disposed between the plurality of first internal coil patterns 211, but is not limited thereto.

The external electrodes 300 and 400 may be disposed on surfaces of the body 100 and connected to the coil patterns 211 and 212, respectively. The external electrodes 300 and 400 may include a first external electrode 300 connected to the first coil pattern 211 and a second external electrode 400 connected to the second coil pattern 212.

More specifically, the first external electrode 300 may include a first connection portion 310 disposed on the first surface, one end surface of the body 100, and connected to the end portion of the first coil pattern 211 and a first extension portion 320 extending from the first connection portion 310 to the sixth surface, one surface of the body 100. The second external electrode 400 may include a second connection portion 410 disposed on the second surface, the other end surface of the body 100, and connected to the end portion of the second coil pattern 212 and a second extension portion 420 extending from the second connection portion 410 to the sixth surface. The first extension portion 320 and the second extension portion 420 may be spaced apart from each other so that the first and second external electrodes 300 and 400 do not come in contact with each other.

The external electrodes 300 and 400 may electrically connect the coil component 1000 to a printed circuit board, or the like, when the coil component 1000 according to the present exemplary embodiment is mounted on the printed circuit board, or the like. As an example, the coil component 1000 according to the present exemplary embodiment may be mounted on the printed circuit board so that the sixth surface of the body 100 faces an upper surface of the printed circuit board, and the extension portions 320 and 420 of the external electrodes 300 and 400 disposed on the sixth surface of the body 100 and a connection portion of the printed circuit board may be electrically connected to each other by solder, or the like.

The external electrodes 300 and 400 may be formed by printing a conductive paste or formed by electroplating. The external electrodes 300 and 400 may contain at least one of copper (Cu), aluminum (Al), silver (Ag), tin (Sn), gold (Au), nickel (Ni), lead (Pb), and titanium (Ti).

As an example, the external electrodes 300 and 400 may be conductive resin layers formed by printing a conductive paste, or the like. The conductive resin layer may contain one or more conductive metals selected from the group consisting of copper (Cu), nickel (Ni), and silver (Ag), and a thermosetting resin.

As another example, the external electrodes 300 and 400 may be electroplating layers formed by electroplating. In this case, a seed layer SL may be formed on at least one of the first, second, and sixth surfaces of the body 100 in order to form the external electrodes 300 and 400 by electroplating.

The seed layer SL may be formed by printing a conductive paste on the surface of the body 100, stacking metal foil on the surface of the body 100, or performing vapor deposition such as sputtering, or the like, on the surface of the body 100. The seed layer SL may contain at least one of copper (Cu), aluminum (Al), silver (Ag), tin (Sn), gold (Au), nickel (Ni), lead (Pb), titanium (Ti), and chromium (Cr). Meanwhile, the seed layer SL may be omitted when the body 100 has conductivity required in forming the external electrodes 300 and 400 by an electroplating method.

The connection portions 310 and 410 and the extension portions 320 and 420 may be formed by the same process, such that the first connection portion 310 and the first extension portion 320 may be formed integrally with each other, and the second connection portion 410 and the second extension portion 420 may be formed integrally with each other. However, connection portions 310 and 410 and the extension portions 320 and 420 are not limited thereto.

The shielding via 500 may have a permeability higher than that of the body 100 and be embedded in the body 100 in the thickness (T) direction of the body 100. Even though the shielding via 500 and the body 100 contain the same magnetic material, since the body 100 further contains the resin, the permeability of the shielding via 500 may be larger than that of the body 100 depending on a difference in resin content or the presence or absence of the resin. Here, the term "permeability" means a relative permeability.

A magnetic flux leaked to the outside of the body 100 may be decreased by embedding the shielding via 500 having a permeability higher than that of the body 100 in the body 100. Therefore, inductance L and a quality (Q) factor of the coil component 1000 according to the present exemplary embodiment may be improved.

The shielding via 500 may contain a metal magnetic material.

The metal magnetic material may contain one or more selected from the group consisting of iron (Fe), silicon (Si), chromium (Cr), boron (B), cobalt (Co), molybdenum (Mo), aluminum (Al), niobium (Nb), copper (Cu), and nickel (Ni). For example, the metal magnetic material may be at least one of pure iron, a Fe—Si based alloy, a Fe—Si—Al based alloy, a Fe—Ni based alloy, a Fe—Ni—Mo based alloy, a Fe—Ni—Mo—Cu based alloy, a Fe—Co based alloy, a Fe—Ni—Co based alloy, a Fe—Cr based alloy, a Fe—Cr—Si based alloy, a Fe—Si—Cu—Nb based alloy, a Fe—Ni—Cr based alloy, and Fe—Cr—Al based alloy.

The metal magnetic material may be amorphous or crystalline. For example, the metal magnetic material may be a Fe—Si—B—Cr based amorphous alloy, but is not necessarily limited thereto.

The permeability of the shielding via 500 may be, for example, more than 30, but is not limited as long as the permeability of the shielding via 500 is larger than that of the body 100.

The shielding via 500 may be formed by processing a via hole for forming a shielding via in the body 100 and filling the via hole for forming a shielding via with the magnetic material. The via hole for forming a shielding via may be formed in the thickness (T) of the body 100 in consideration of a direction of a magnetic flux formed by the coil part 200. That is, the via hole for forming a shielding via may be formed in the fifth or sixth surface of the body 100 in the thickness (T) direction of the body 100. As a result, the shielding via 500 may be exposed to at least one, or both, of the fifth and sixth surfaces of the body 100 opposing each other in the thickness (T) direction of the body 100.

The shielding via 500 may be formed to have various cross-sectional shapes such as a circle, an oval, a polygon, and the like. The shielding via 500 may be formed of a single layer or a multilayer.

A plurality of shielding vias 500 may be formed and embedded in the body 100 so as to be spaced apart from each other. An effect of decreasing a leakage magnetic flux may be improved by forming the plurality of shielding vias 500.

Meanwhile, although not illustrated in FIGS. 1 through 3, an external insulating layer may be formed in a region of the surface of the body 100 on which the external electrodes 300 and 400 are not formed. That is, the external insulating layer may be formed on the third to fifth surfaces of the body 100 on which the connection portions 310 and 410 are not formed and a region of the sixth surface of the body 100 on which the extension portions 320 and 420 are not formed. The external insulating layer may serve as a plating resist in forming the external electrodes 300 and 400 by electroplating, but is not limited thereto.

Further, although not illustrated in FIGS. 1 through 3, an additional insulating layer distinguished from the above-mentioned external insulating layer may be formed between the sixth surface of the body 100 and the extension portions 320 and 420. When the body 100 is formed by a sintering method or a curing method, a surface roughness may be formed in the surface of the body 100 in a high range. In a case of forming the external electrodes 300 and 400 directly on the surface of the body 100 as described above by electroplating, surfaces of the external electrodes 300 and 400 may have a high surface roughness, such that flatness may not be satisfactory. Therefore, the additional insulating layer may be formed on the surface of the body 100, thereby preventing the surface roughness formed on the surface of the body 100 in a high range from being transferred to the external electrodes 300 and 400. When the additional insulating layer is formed on the surface of the body 100, the above-mentioned seed layer SL may be disposed between the additional insulating layer and the external electrodes 300 and 400.

The coil component 1000 according to the present exemplary embodiment may more efficiently block the leakage magnetic flux by forming the shielding via 500 having a permeability higher than that of the body 100 in the body 100. Further, since the leakage magnetic flux may be decreased by forming the shielding via 500 in the coil component itself without using a separate member such as a shield can, such that the coil component 1000 may be advantageous for thinness and high performance of an electronic device. In addition, since in the coil component 1000 according to the present exemplary embodiment, an amount of an effective magnetic material in a shielding region is increased as compared to a case of using a shield can, characteristics of the coil component such as inductance L, the Q factor, and the like, may be improved.

Second Exemplary Embodiment

Figure 4:
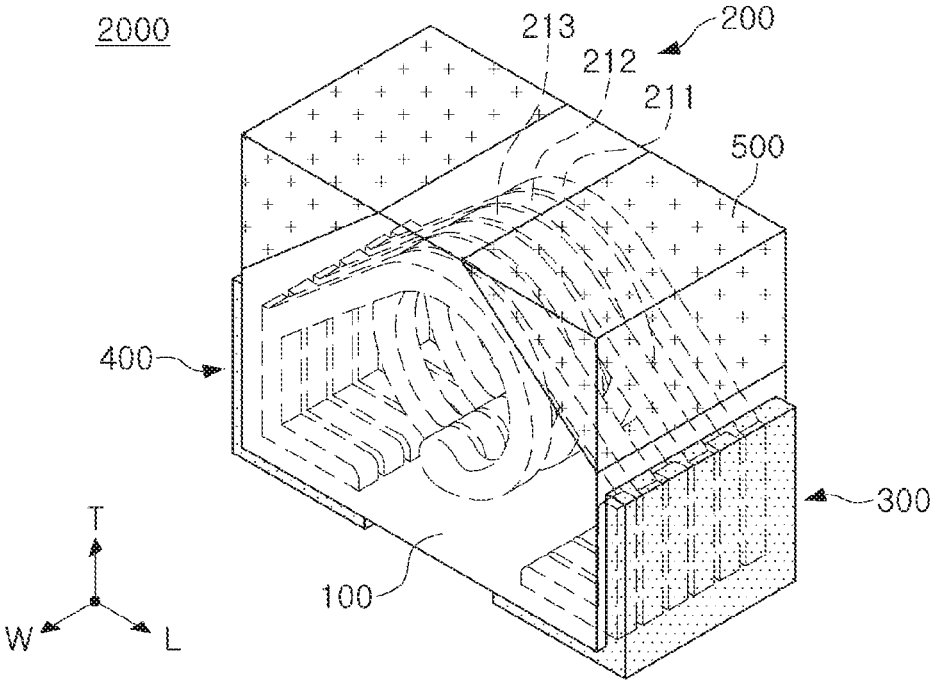
FIG. 4 is a perspective view schematically illustrating a coil component according to a second exemplary embodiment in the present disclosure.
Figure 5:
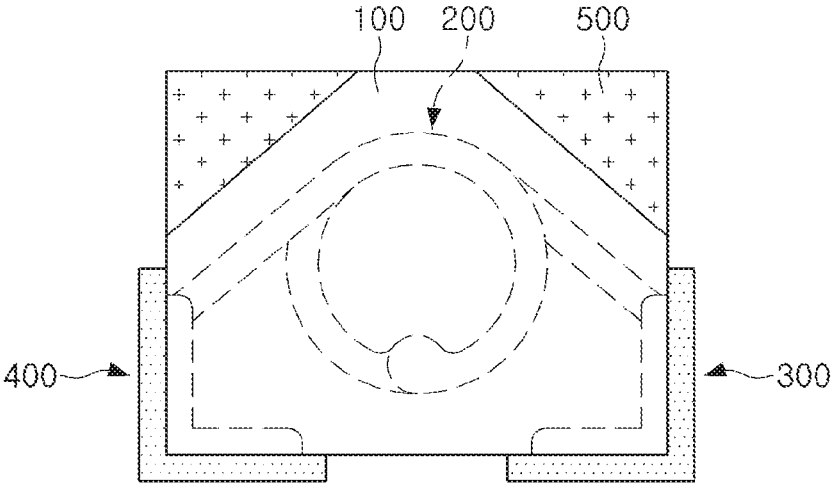
FIG. 5 is a front view schematically illustrating the coil component according to the second exemplary embodiment in the present disclosure.

FIG. 4 is a perspective view schematically illustrating a coil component according to a second exemplary embodiment in the present disclosure. FIG. 5 is a front view schematically illustrating the coil component according to the second exemplary embodiment in the present disclosure.

Referring to FIGS. 1 through 5, a coil component 2000 according to the present exemplary embodiment is different in a structure in which a coil part 200 and a shielding via 500 are disposed from the coil component 1000 according to the first exemplary embodiment in the present disclosure. Therefore, in describing the present exemplary embodiment, only the coil part 200 and the shielding via 500 that are different from those in the first exemplary embodiment in the present disclosure will be described. To the other configurations in the present exemplary embodiment, a description of those in the first exemplary embodiment may be applied as it is.

Referring to FIGS. 4 and 5, in the coil part 200 applied to the present exemplary embodiment, coil patterns 211, 212, and 213 each forming at least one turn winding around a width (W) direction of a body 100 may be sequentially disposed in the width (W) direction of the body 100 and connected to each other by a connection via. That is, the coil part 200 according to the present exemplary embodiment may correspond to a vertically disposed coil forming turns perpendicular to the lower surface of the body 100 in FIGS. 4 and 5. The coil part 200 according to the present exemplary embodiment may generate a magnetic flux in the width (W) direction of the body 100 unlike the first exemplary embodiment in the present disclosure.

The body and the respective coil patterns 211 to 213 may be formed by printing a conductive paste on a magnetic sheet or a magnetic composite sheet, stacking a plurality of magnetic sheets or magnetic composite sheets on which the conductive paste is printed, and then sintering or curing the stacked magnetic sheets or magnetic composite sheets.

Both ends of the coil part 200 may be each exposed to a sixth surface of the body 100 parallel with the width (W) direction of the body 100 to thereby be connected to first and second external electrodes 300 and 400 disposed on the sixth surface of the body 100 to be spaced apart from each other, respectively.

In addition, as illustrated in FIGS. 4 and 5, one end of the coil part 200 may be exposed to second and sixth surfaces of the body 100, and the other end of the coil part 200 may be exposed to first and sixth surfaces of the body 100, such that electrical connection between the coil part 200 and the external electrodes 300 and 400 may be more surely carried out.

Further, as illustrated in FIGS. 4 and 5, electrical connection between the coil part 200 and the external electrodes 300 and 400 may be more surely carried out by connecting the respective coil patterns 211 to 213 constituting the coil part 200 to the external electrodes 300 and 400.

The shield via 500 may be exposed to at least two surfaces of the body 100 meeting each other among a plurality of surfaces of the body 100. That is, the shielding via 500 may formed in an edge region at which one surface of the body 100 meets another surface of the body 100. As an example, the shielding via 500 may be formed in a shape of a triangular prism exposed to the second and fifth surfaces of the body 100 connected to each other.

In this way, interferences with another electronic component may be decreased by changing a direction of the magnetic flux of the coil part 200 in the coil component 2000 according to the present exemplary embodiment. In addition, characteristics of the coil component may be maintained and a component mounting area may be significantly decreased, which is advantageous for miniaturization and high performance of an electronic device.

Further, in the coil component 2000 according to the present exemplary embodiment, the shielding via 500 may be formed in the edge region of the body 100, thereby preventing an electromagnetic field from being concentrated on the edge region of the body 100 to more efficiently decrease the leakage magnetic flux.

Third Exemplary Embodiment

Figure 6:
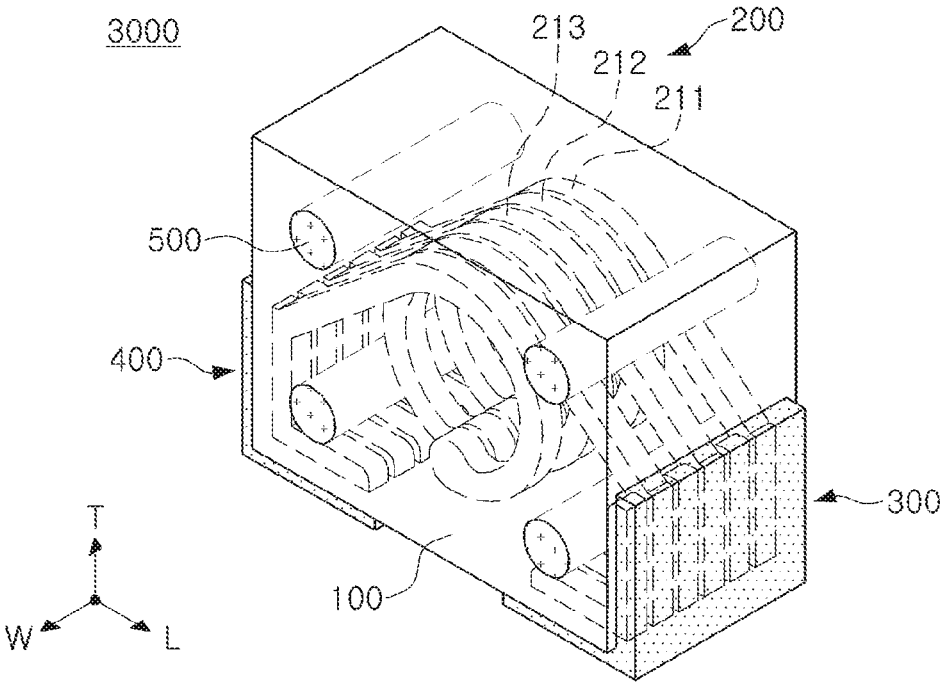
FIG. 6 is a perspective view schematically showing a coil component according to a third exemplary embodiment in the present disclosure.
Figure 7:
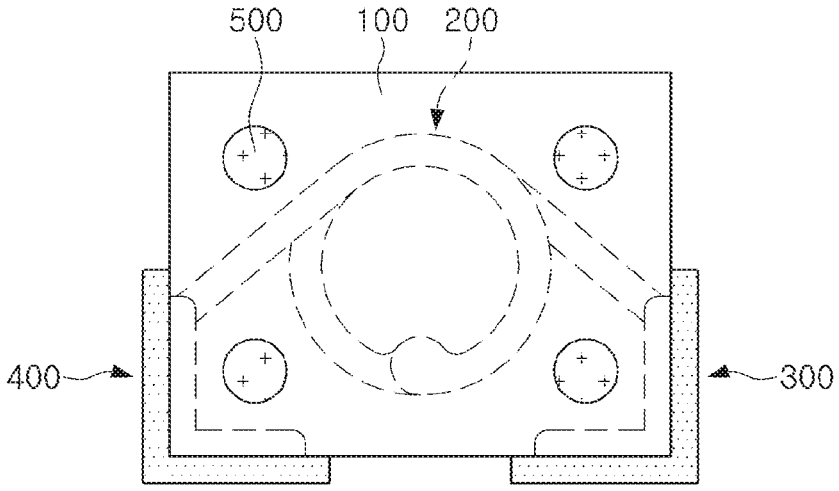
FIG. 7 is a front view schematically illustrating the coil component according to the third exemplary embodiment in the present disclosure.

FIG. 6 is a perspective view schematically showing a coil component according to a third exemplary embodiment in the present disclosure. FIG. 7 is a front view schematically illustrating the coil component according to the third exemplary embodiment in the present disclosure.

Referring to FIGS. 1 through 7, a coil component 3000 according to the present exemplary embodiment is different in a structure in which a shielding via 500 is disposed from the coil component 2000 according to the second exemplary embodiment in the present disclosure. Therefore, in describing the present exemplary embodiment, only the structure in which the shielding via 500 is disposed, different from that in the second exemplary embodiment in the present disclosure will be described. To the other configurations in the present exemplary embodiment, a description of those in the second exemplary embodiment may be applied as it is.

Referring to FIGS. 6 and 7, the shielding via 500 applied to the present exemplary embodiment may be formed in a body 100 rather than an edge region of the body 100 to be spaced apart from a coil part 200.

In the second exemplary embodiment in the present disclosure, since the shielding via 500 constitutes the surface of the body 100 including the edge of the body 100, there is a need to form a precursor material for forming the shielding via on the magnetic sheet or magnetic composite sheet for forming the body 100. However, the shielding via 500 applied to the present exemplary embodiment does not constitute a surface of the body 100 including the edge of the body 100. Therefore, the shielding via 500 applied to the present exemplary embodiment may be selectively formed in the body 100 after the body 100 is formed.

Therefore, a manufacturing process of the coil component 3000 according to the present exemplary embodiment may be more simplified. Further, since the shielding via 500 may be selectively formed at a position of the body 100 in which a leakage magnetic flux is generated, the coil component 3000 according to the present disclosure may effectively decrease the leakage magnetic flux through a more simple method.

Fourth Exemplary Embodiment

Figure 8:
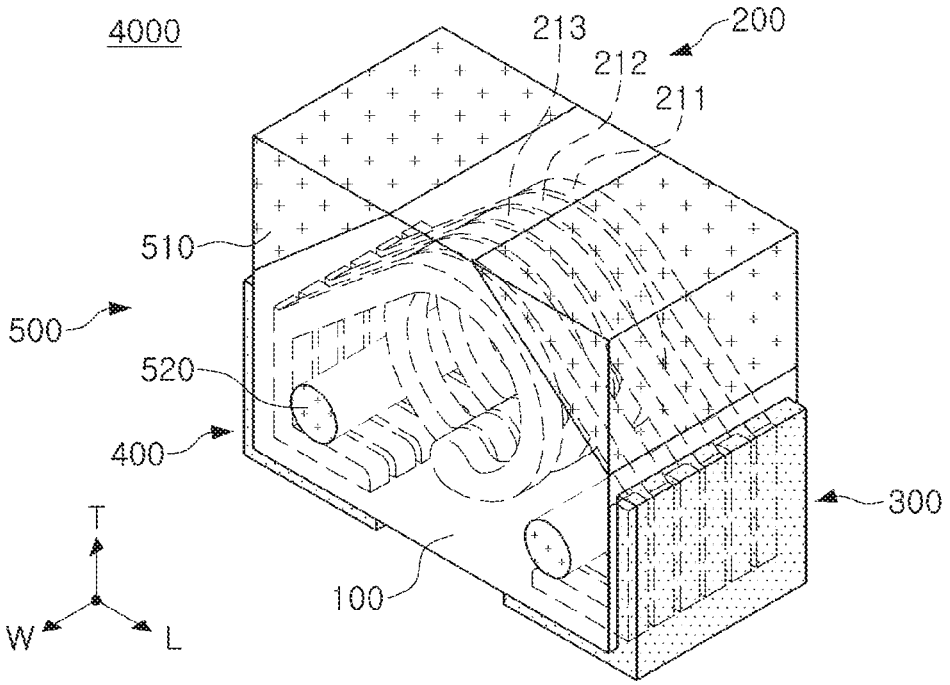
FIG. 8 is a perspective view schematically showing a coil component according to a fourth exemplary embodiment in the present disclosure.
Figure 9:
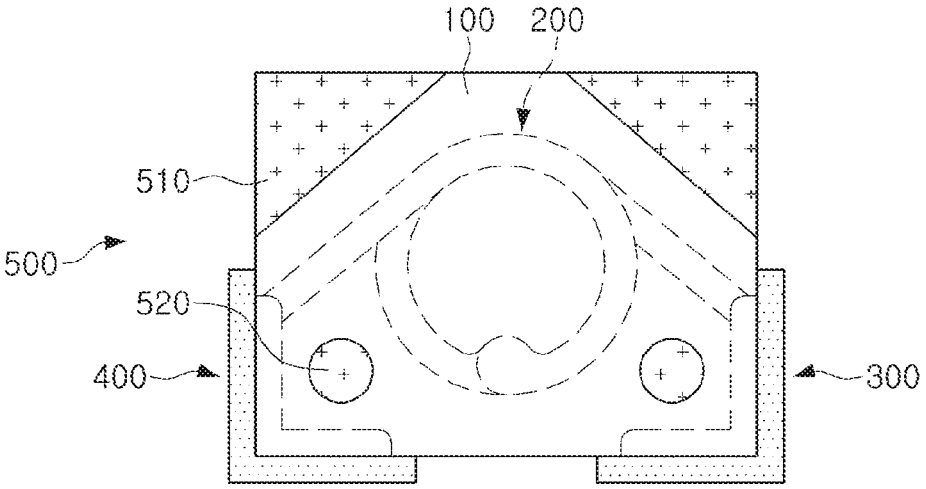
FIG. 9 is a front view schematically illustrating the coil component according to the fourth exemplary embodiment in the present disclosure.

FIG. 8 is a perspective view schematically showing a coil component according to a fourth exemplary embodiment in the present disclosure. FIG. 9 is a front view schematically illustrating the coil component according to the fourth exemplary embodiment in the present disclosure.

Referring to FIGS. 1 through 8, a coil component 4000 according to the present exemplary embodiment is different in a structure in which a shielding via 500 is disposed from the coil components 2000 and 3000 according to the second and third exemplary embodiments in the present disclosure. Therefore, in describing the present exemplary embodiment, only the structure in which the shielding via 500 is disposed, different from those in the second and third exemplary embodiments in the present disclosure will be described. To the other configurations in the present exemplary embodiment, a description of those in the second and third exemplary embodiments may be applied as it is.

The shielding via 500 applied to the present exemplary embodiment may include a first shielding via 510 formed in an edge region of a body 100 and exposed to at least two surfaces of the body 100 meeting each other among a plurality of surfaces of the body 100, and a second shielding via 520 formed in the body 100 rather than the edge region of the body 100 to be spaced apart from a coil part 200.

A plurality of first shielding via 510 and a plurality of second shielding vias 520 may be formed.

Therefore, the coil component 4000 according to the present exemplary embodiment may have all the advantages in the second and third exemplary embodiments described above. That is, the coil component 4000 according to the present exemplary embodiment may prevent an electromagnetic field from being concentrated on the edge region of the body 100 by the first shielding via 510, and may effectively shield a leakage magnetic flux by selectively forming the second shielding via 520 after forming the body 100.

As set forth above, according to exemplary embodiments in the present disclosure, the leakage magnetic flux of the coil component may be decreased.

Further, the leakage magnetic flux of the coil component may be decreased, and the characteristics of the component such as inductance L, the quality (Q) factor, and the like, may be improved.

While exemplary embodiments have been shown and described above, it will be apparent to those skilled in the art that modifications and variations could be made without departing from the scope of the present invention as defined by the appended claims.

What is claimed is:

1. A coil component comprising:

a body;

a coil part including a coil pattern embedded in the body and having at least one turn winding around one direction;

first and second external electrodes disposed on a surface of the body and connected to the coil part; and a shielding via having a permeability higher than that of the body and extending along the one direction in the body, wherein the shielding via is spaced apart from a core of the body, the core of the body being surrounded by the at least one turn of the coil pattern, and the shielding via is exposed to one or both surfaces of the body opposing each other in the one direction.

2. The coil component of claim 1, wherein the shielding via is also exposed to another surface of the body, the another surface of the body connected the both surfaces of the body opposing each other in the one direction.

3. The coil component of claim 1, wherein the shielding via includes a plurality of vias embedded in the body and spaced apart from each other.

4. The coil component of claim 1, further comprising an internal insulating layer embedded in the body, wherein the coil part includes:

first and second coil patterns disposed on both surfaces of the internal insulating layer opposing each other in the one direction, respectively; and a connection via penetrating through the internal insulating layer so as to connect the first and second coil patterns to each other.

5. The coil component of claim 4, further comprising an insulating film formed along surfaces of the first coil pattern, the internal insulating layer, and the second coil pattern.

6. The coil component of claim 1, wherein both ends of the coil part are exposed to both end surfaces of the body opposing each other, respectively, among a plurality of wall surfaces of the body connecting both surfaces of the body opposing in the one direction, and the first and second external electrodes include:

connection portions disposed on both end surfaces of the body and connected to the coil part; and extension portions extending from the connection portions and disposed on one surface of both surfaces of the body in the one direction, respectively, the extension portions spaced apart from each other.

7. The coil component of claim 1, wherein both ends of the coil part are exposed to one surface of the body parallel with the one direction, respectively, and the first and second external electrodes are disposed on the one surface of the body to be spaced apart from each other.

8. The coil component of claim 1, wherein the shielding via penetrates through the body.

* * * * *